US005293828A

United States Patent [19]

Nishizawa et al.

[11] Patent Number: 5,293,828

[45] Date of Patent: Mar. 15, 1994

[54] AUTOMATIC SEWING MACHINE CONTROL DEVICE

[75] Inventors: Yoshifumi Nishizawa; Iwao Yamane; Satoru Yamada, all of Aichi, Japan

[73] Assignee: Mitsubishi Denki Kabushiki Kaisha, Tokyo, Japan

[21] Appl. No.: 824,290

[22] Filed: Jan. 23, 1992

[30] Foreign Application Priority Data

Jan. 23, 1991 [JP] Japan ..... 3-006531

[51] Int. Cl.[5] ..... D05B 19/00

[52] U.S. Cl. ..... 112/121.11; 112/262.1; 112/277

[58] Field of Search ..... 112/121.12, 121.11, 112/277, 275, 220, 262.1

[56] References Cited

U.S. PATENT DOCUMENTS 4,648,339 3/1987 Fujikawa ..... 112/277
4,683,827 8/1987 Kinoshita et al. ..... 112/121.12
4,883,008 11/1989 Hiramatsu ..... 112/277
5,065,682 11/1991 Tajima et al. ..... 112/121.12 X

*Primary Examiner*—Peter Nerbun
*Attorney, Agent, or Firm*—Sughrue, Mion, Zinn, Macpeak & Seas

[57] ABSTRACT

A control device for an automatic sewing machine in which a cloth presser unit holding a material to be sewed is moved according a predetermined pattern thereby to form a seam having a predetermined pattern. The control device controls the speed of rotation of the automatic sewing machine and the movement of the cloth presser unit with high accuracy to obtain seams which are excellent in quality.

11 Claims, 16 Drawing Sheets

| SPEED \ STITCH WID. | 0.1 | 0.2 | 0.3 | 0.4 | - - - | 12.5 | 12.6 | 12.7 |
|---|---|---|---|---|---|---|---|---|
| D | 100 | 99 | 98 | 97 | - - - | — | — | — |
| C | | | | | | | | |
| B | | | | | | | | |
| A | | | | | | | | |
| 9 | | | | | | | | |
| 8 | | | | | | | | |
| 7 | | | | | | | | |
| 6 | | | | | | | | |
| 5 | | | | | | | | |
| 4 | | | | | | | | |
| 3 | | | | | | | | |
| 2 | | | | | | | | |
| 1 | | | | | | | | |
| 0 | 110 | 109 | 108 | 106 | - - - | 20 | 18 | 17 |

AUTOMATIC SEWING MACHINE CONTROL DEVICE

BACKGROUND OF THE INVENTION

The present invention relates to an automatic sewing machine in which a cloth presser unit holding a material to be sewed is moved according a predetermined pattern thereby to form a seam having a predetermined pattern, and more particularly to a control device for controlling the speed of rotation of the automatic sewing machine and the movement of the cloth presser unit.

FIG. 14 shows an external appearance of a conventional ordinary automatic sewing machine. The automatic sewing machine comprises: a sewing machine mechanism section 25 provided on a sewing machine table 201, the sewing machine mechanism section 25 incorporating a mechanism for forming seams on a material to be sewed with a needle bar 202; an electric motor 203 for driving the sewing machine mechanism section 25; a cloth presser unit 206 for holding a material to be sewed (hereinafter referred to as "a sewing material," when applicable) between an upper presser plate 204 and a lower presser plate 205 by using an air pressure; and a biaxial drive mechanism 208 for horizontally moving the cloth presser unit 206 on a shuttle race slide 207. A control device 224 for controlling the operations of the above-described components is provided, in the form of two upper and lower layers, in one side portion of the table 201. The upper portion of the control device comprises: an operating panel 40 including a variety of switches for specifying a desired operation for the automatic sewing machine; and a data reading unit for reading data on the patterns of movement of the biaxial drive mechanism 208 from a data storing medium (not shown) which is detachably mounted therein, to control the timing of the operations of the whole sewing machine and the movement of the biaxial drive mechanism 208.

The operating panel 40 has a power switch 211, a reset switch 222 for positioning the biaxial drive mechanism 208 in place to reset the system; and a test switch for driving the two axes according to a given sewing data with the needle maintained stopped.

A foot pedal 31 shown in the lower portion of FIG. 14 includes: a start switch 217 for providing a sewing start instruction; and a switch 214 for activating the cloth presser unit 206 (hereinafter referred to as "a cloth presser switch 204," when applicable). The sewing machine mechanism section 25 has a stop switch 215 for suspending a sewing operation. The sewing machine further comprises: origin detecting units 29 and 30 provided for the biaxial drive mechanism 208 to detect the mechanical origins of the two axes.

Further in FIG. 14, reference numeral 40 designates the aforementioned operating panel for specifying a sewing pattern and a sewing speed; 220, a liquid crystal display unit for displaying operating procedures, current sewing conditions, and error messages (hereinafter referred to as "an LCD 220," when applicable); 222, a reset switch for resetting a positioning system at a predetermined position; 223, a group of switches including digital keys for setting sewing patterns, the aforementioned reset switch 222, and a speed setting switch 221; 47, a magnetic data writing and reading unit for writing data in a floppy disk (hereinafter referred merely to as "an FD," when applicable) and reading data therefrom (hereinafter referred to as "an FDD 47," when applicable); and 224, the aforementioned control device for controlling the operations of the automatic sewing machine.

The arrangement of the control device 224 will be described with reference to FIG. 20.

In FIG. 20, reference numeral 1 designates a microcomputer including a CPU and a direct memory access (hereinafter referred to as "a DMA," when applicable) for making access to memory directly without the aid of an external interruption controller or the CPU; 32, a crystal oscillator for producing a fundamental frequency to operate the microcomputer; 2, a memory address latch circuit (for instance 74LS373) for latching an address in a memory (RAM 61 and ROM 7); 3, a memory data buffer (for instance 74LS245) for transferring data from the memory (ROM 7 and RAM 61) to the microcomputer or vice versa; 4, a peripheral data buffer (for instance 74LS245) for transferring data from the microcomputer 1 to peripheral elements other than the memory or vice versa; 5, an IC selection signal generating circuit (hereinafter referred to as "a decoder 5," when applicable) for producing IC selection signals to select the memory (ROM 7 and RAM 61) and the periphery elements, respectively; 61, a data writing and reading memory element (hereinafter referred to as "a RAM," when applicable); 7, a non-volatile read-only memory element (hereinafter referred to as "a ROM," when applicable); and 33, a power source backup circuit which provides its output power normally for several days to eliminate the difficulty that, in the case where a RAM is employed as a data writing and reading memory element, all the contents of the RAM are erased when the power switch is turned off because the RAM is a volatile memory element.

Further in FIG. 20, reference numeral 43 designates a frequency divider circuit for frequency-dividing the signal having a predetermined frequency outputted by the microcomputer 1, the output of the frequency divider circuit being applied to a serial communication element 34 and a keyboard controller 37; 34, the aforementioned serial communication element (for instance 8251) connected to the peripheral data buffer for converting parallel data to serial data or serial data into parallel data; 60, a driver for modifying the output data of the serial communication element 34 in accordance with a communication standard (for instance RS-232C or RS-422) (hereinafter referred to as "a serial communication driver 60," when applicable), the serial communication drive 60 having an input element and an output element; and 36, a unit which receives an input signal when the serial communication drive 60 provides an output signal, and which provides an output signal when the serial communication driver 60 receives an input signal. That is, the unit 36 is a party for serial communication, and it is for instance a personal computer (hereinafter referred to as "a serial communication object 36," when applicable).

Further in FIG. 20, reference numeral 37 designates a keyboard controller for controlling the group of switches 223, the speed switch 221 and the reset switch 222 on the operating panel 40; 38, an input and output interface circuit for the keyboard controller; 41, an LCD controller for driving the LCD 220 in the operating panel; 42, an interface circuit for an output from the LCD controller and an input from the LCD; 44, an interruption controller which receives the output signals of the keyboard controller 37 and a feed pulse delay circuit 45 directly, and the output signal of a detector 26 through an input interface circuit 10, to cause the microcomputer 1 to provide an interruption signal; 45, the aforementioned feed pulse delay circuit for determining the timing of generation of a feed pulse with the aid of the output data of an I/0 8 and the output signal of the detector 26; 46, a floppy disk controller (hereinafter referred to as "an FDC 46," when applicable) for transmitting signals to and receiving signals from the floppy disk driver 47; 47, the aforementioned floppy disk driver for writing data in a memory medium, namely, an FD 48 in response to a signal from the FDC 46; 8, the aforementioned I/0 for controlling a variety of parallel input and output signals; 10, 11, 12, 52 and 55, input interface circuits for receiving an input signal externally provided to be applied to the I/0 8.

Further in FIG. 20, reference numeral 13 designates a power circuit for driving pulse motors in the biaxial drive section of the sewing machine (hereinafter referred to as "cloth presser drive output means or PMD," when applicable); 49, a circuit for controlling an eddy current joint type clutch motor (hereinafter referred to as "a motor control circuit," when applicable); 50, a power circuit section for operating the eddy current joint type clutch motor in response to a signal from the motor control circuit 49; 15, a switch section for changing a sewing machine control method (hereinafter referred to as "a sewing machine control method changing switch group," when applicable); 55, an interface circuit used when the I/0 8 receives signals from other than the control board; 16-*a*, an instantaneous power interruption detecting circuit for preventing the erroneous operation of the control board for instance when the main supply voltage is lowered temporarily; and 16-*b*, a power source circuit for supplying electric power to the control board.

FIG. 15 is a diagram for a description of the speed control of the conventional automatic sewing machine and one example of the actual speeds of the same. More specifically, the upper half of FIG. 15 shows speed instruction values which are applied to the motor 203 by the control circuit 50, and the lower half of FIG. 15 shows the actual speeds of rotation of the sewing machine arm shaft (not shown) with the speed instruction values. In the lower half of FIG. 15, the region A shows the fact that, although the speed instruction value is set to 2000 rpm, the actual rotation of the sewing machine arm shaft does not reach 2000 rpm; the region B shows the fact that the rotation of the sewing machine arm shaft becomes unstable because the motor is being controlled; the region C shows the fact that the rotation of the sewing machine arm shaft is stable; the region D shows the delay time in speed reduction of the sewing machine with the speed instruction value decreased to 200 rpm; and the region E shows the speed reduction time.

FIG. 16 shows two patterns of speed reduction. The upper half of FIG. 16 shows speed instruction values, and the lower half shows the speeds of the sewing machine arm shaft. The speed instruction value is 2000 rpm in the region F, 1400 rpm in the region G, 2000 rpm in the region H, and 400 rpm in the region J. On the other hand, the region K is the period in which the speed instruction value is stable, 2000 rpm; the region L is the period in which the speed of the sewing machine arm shaft is decreased with the speed instruction value decreased to 1400 rpm; the region M is the period in which the speed is being decreased; the region N is the period in which the speed is increased to 2000 rpm; the region P is the period in which the speed is held stable at 2000 rpm; the region Q is the period in which the speed of the sewing machine arm shaft is decreased when compared with the speed instruction value; and the region R is the period in which the speed is decreased to 400 rpm.

FIG. 17 shows the arrangement of the feed pulse delay circuit in detail. The detailed description of the operation of the feed pulse delay circuit will not be made here because it has been made by Published Examined Japanese Patent Application Nos. 29515/1985 and 54076/1985. That is, only the things will be described here which have not been described by these Japanese Patent Application Publications.

FIG. 18 shows the waveforms of signals in the feed pulse delay circuit shown in FIG. 17 in the case where the speed is low, 200 rpm. FIG. 19 shows the waveforms of signals in the feed pulse delay circuit in the case where the speed is high, 2000 rpm. $\alpha$ in FIG. 18 represents an inhibit period of time from a leading edge of a needle lower position signal DN to a leading edge of a feed pulse for driving a presser foot and $\beta$ in FIG. 18 represents a period of time in which the feed pulse is produced. $\gamma$ represents a period of time which is an interval defined by the first feed pulse and the second feed pulse. Similarly, e in FIG. 19 represents an inhibit period of time up to an occurrence of the feed pulse. In FIG. 19, $\phi$ represents a feed pulse production period, and $\theta$ represents an interval of the first and second feed pulses. As is apparent from the $\gamma$ in FIG. 18 and 8 in FIG. 19, even in the case of $X-OUT=9$ pulses, the feed pulse interval $|X-OUT|$ differs from each other.

In the conventional automatic sewing machine thus constructed, it is impossible to set the speed of the spindle to an aimed value, and accordingly the cloth presser unit is not moved to a predetermined position (stepping out). Furthermore, the waveform of the feed pulse X-OUT changes with the speed of rotation of the sewing machine arm shaft, so that the cloth pressure unit steps out.

SUMMARY OF THE INVENTION

An object of the present invention is to eliminate the above-described difficulties accompanying a conventional automatic sewing machine. More specifically, an object of the invention is to provide a control device for an automatic sewing machine which makes it possible to set the speed of the spindle of the sewing machine to a desired value, and prevents the cloth presser unit from stepping out, thus allowing the sewing machine to form beautiful seams.

The above, and other objects of the present invention are accomplished by the provision of a control device for controlling a sewing machine to carry out an automatic sewing operation according to a sewing pattern data, which comprises a sewing machine body, an electric motor for driving the spindle of the sewing machine body, a cloth presser unit for holding a cloth, a cloth presser drive section for moving the cloth presser unit to a predetermined position, and a control unit for controlling the operations of said motor, cloth presser unit, cloth presser drive section, the control unit comprising a microcomputer carrying out the control operation, first memory means for storing programs for the microcomputer, second memory means for storing the sewing pattern data, sewing pattern data changing means for changing the sewing pattern data into sewing pattern data most suitable for the operation of the sewing machine and third memory means for reading the sewing pattern data same as those in the second memory means, the third memory means storing the changed sewing pattern data from the sewing pattern data changing means.

DESCRIPTION OF THE PREFERRED EMBODIMENT

An embodiment of this invention will be described with reference to the accompanying drawings.

Figure 1:
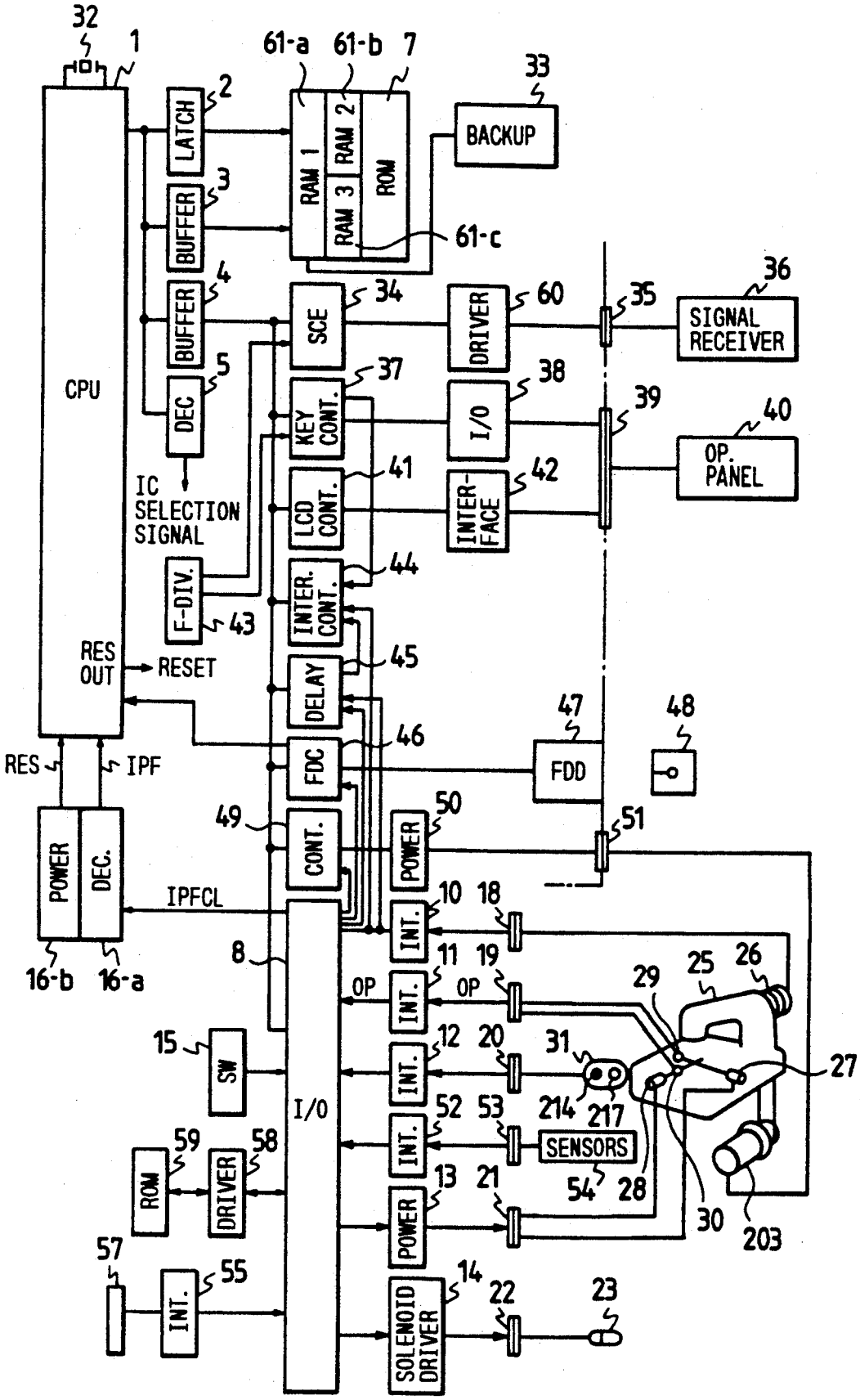
FIG. 1 is a block diagram showing an example of a control device for an automatic sewing machine which constitutes one embodiment of this invention.

In FIG. 1, those components which have been already described with reference to the conventional automatic sewing machine are therefore designated by the same reference numerals or characters. Further in FIG. 1, reference character **61-*a* designates a stacking memory section for storing data to be stored temporarily during the operation of the microcomputer (hereinafter referred to as "a RAM1 61-*a*," when applicable); and 61-*b*, a sewing pattern data memory section for storing sewing pattern data (hereinafter referred to as "a RAM2 61-*b***," when applicable).

Figure 2:
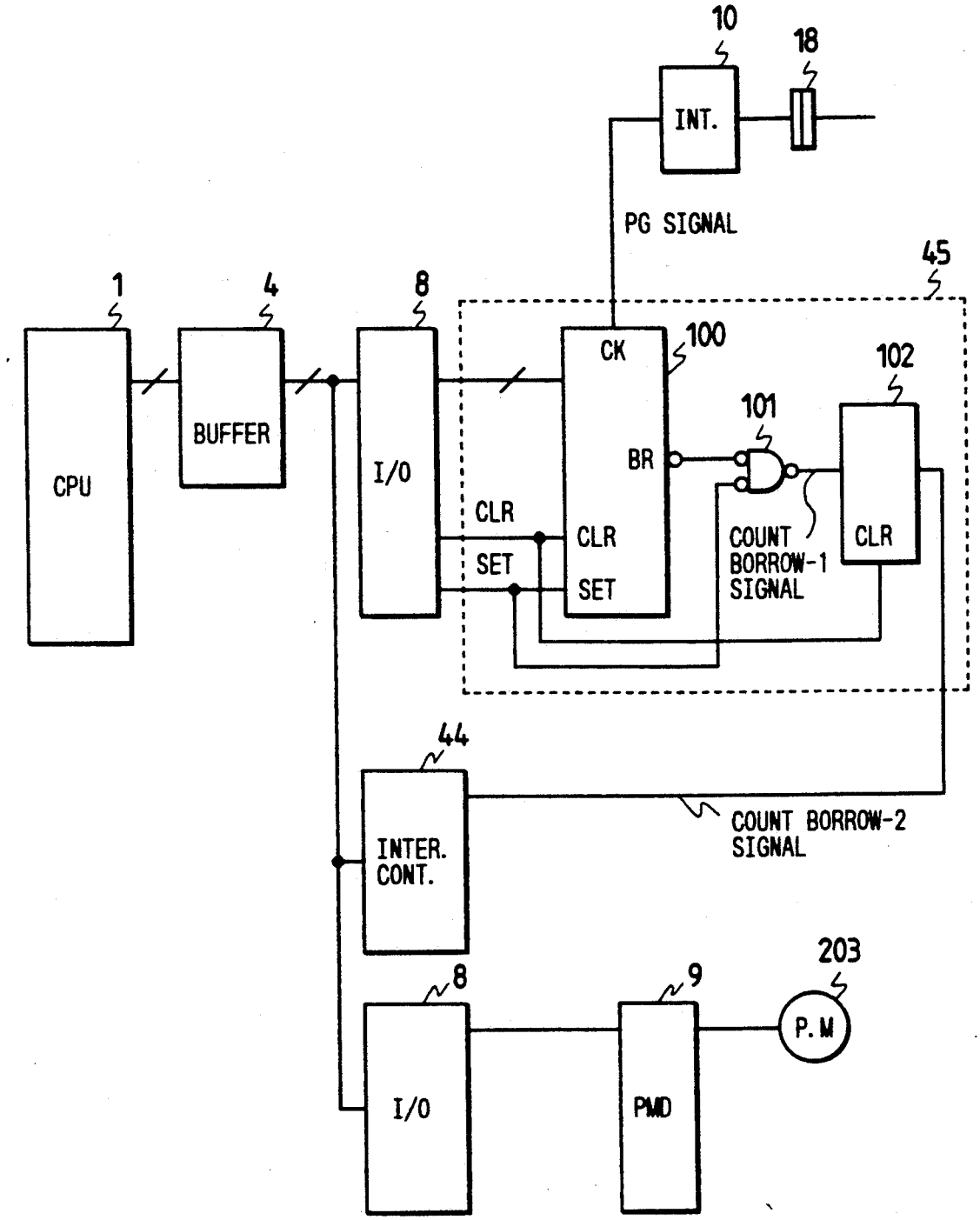
FIG. 2 is a block diagram showing a feed pulse delay circuit in the control device shown in FIG. 1.

In FIG. 2 which is a circuit diagram showing a count borrow circuit of FIG. 1, those circuit elements which have been shown in FIG. 1 are designated by the same reference numerals or characters. Further in FIG. 2, reference numeral 100 designates a counter which reads data which are applied thereto through the I/O 8 by the CPU 1 and counts a PG signal as much as the value thus set which are applied thereto by the sewing machine detector; 101, an OR circuit which is to inhibit the production of a count borrow 1 signal when a counter set signal is at "1"; and 102, a circuit for generating a count borrow 2 signal in response to the count borrow 1 signal.

Figure 3:
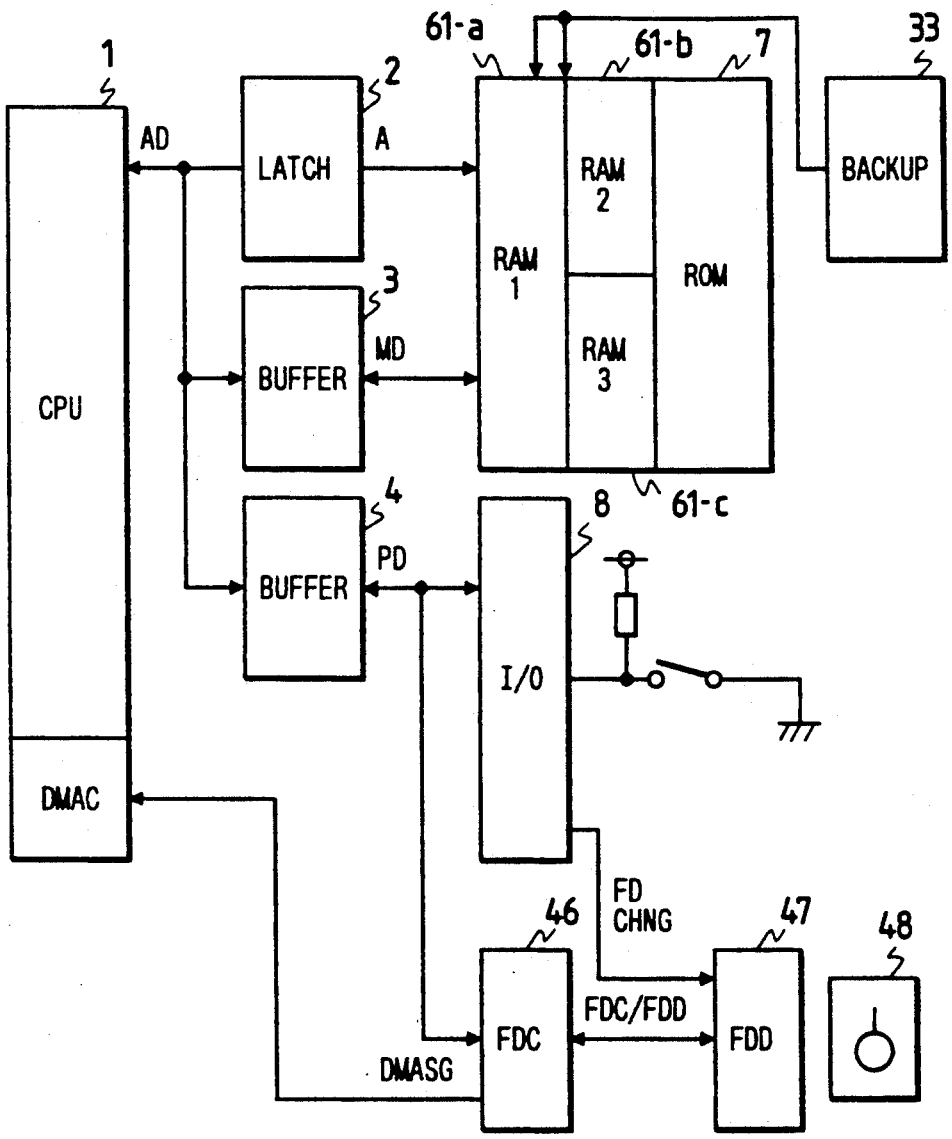
FIG. 3 is a circuit diagram for a description of a sewing pattern data reading operation in the control device shown in FIG. 1.

FIG. 3 shows a circuit for reading sewing pattern data from the floppy disk shown in FIG. 1.

In FIG. 3, those parts which have been shown in FIG. 1 are therefore designated by the same reference numerals or characters. Further in FIG. 3, reference character **61-*c* designates a memory section for storing the sewing pattern data which have been optimized (hereinafter referred to as "a RAM3 61-*c***," when applicable).

The operation of the automatic sewing machine thus organized will be described.

Figure 14:
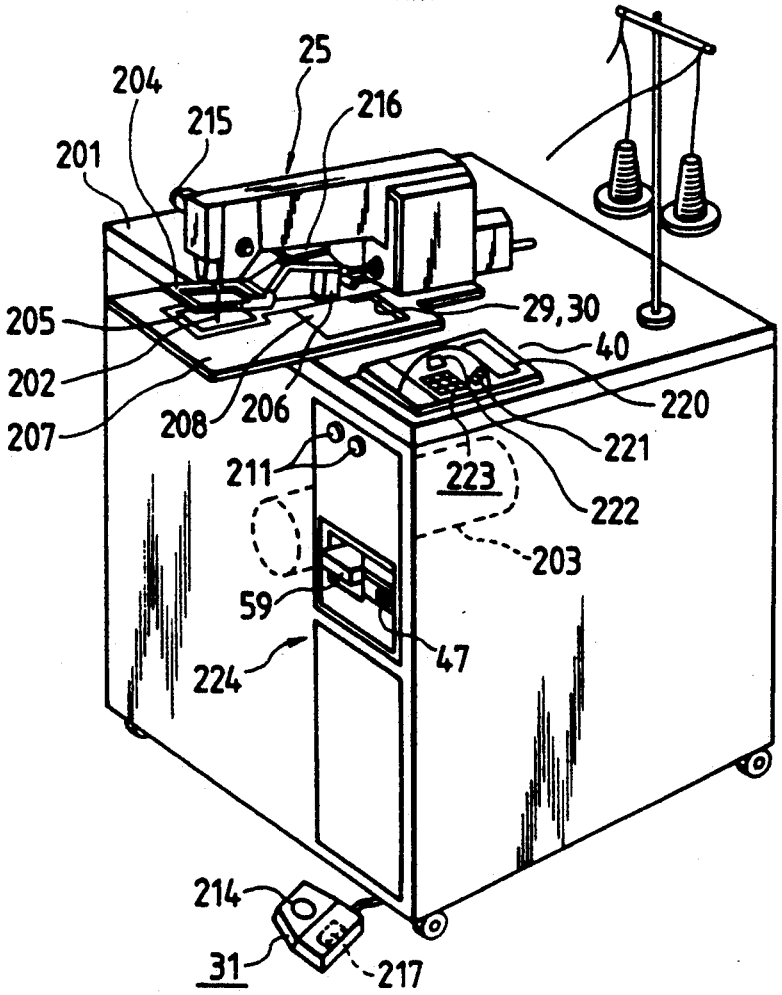
FIG. 14 PRIOR ART
FIG. 14 is a perspective view showing an external appearance of a conventional ordinary automatic sewing machine.

First, the power switches 211 of the control device 224 are closed, so as to start the eddy current joint type clutch motor 203 and to electrically energize the control device 224 shown in FIG. 14. Upon energization of the control device 224, the power source circuit **61-*b* applies a voltage of for instance +5 V to all the elements and circuits, and applies a reset signal (hereinafter referred to as "a RES signal," when applicable) to the microcomputer 1 to prevent the erroneous operations of all the elements and circuits which may take place when the power switch is turned on. The microcomputer 1 is initialized by the reset signal, and simultaneously provides a RES signal at a terminal RESOUT to initialize all the elements and circuits. A predetermined period of time after the provision of the RES signal, the microcomputer 1 reads data from the ROM 7. Next, in order to move the biaxial drive unit 208 to the mechanical origin in response to the signal provided by the origin detecting units 29 and 30, the microcomputer 1 supplies a signal to the PMD 13 through the I/0 8. As a result, the biaxial drive unit 208 is moved towards the mechanical origin by pulse motors 27 and 28. Upon reception of an origin signal (OP in FIG. 1) from the original detecting units 29 and 30, the microcomputer 1 suspends the application of the signal to the pulse motor 27 and 28 thereby to stop the biaxial drive unit 208** at the mechanical origin.

Now, the operation of the operating panel 40 will be described.

Roughly stated, the operating panel 40 is made up of a display section, namely, the LCD 220, and a group of switches 223 for performing a variety of setting operations. The LCD receives signals through the LCD interface circuit from the LCD controller 41 performs a variety of displays such as a sewing pattern number, sewing speed, enlarging or reducing rate, a position where a trouble takes place, a trouble shooting method, and a sewing machine operating method. The group of switches 223 are controlled by the keyboard controller (for instance 8279); that is, the keyboard controller, forming a key matrix, monitors the on-off operation of each of the switches. For instance when the origin return switch 222 is depressed, it provides an output signal, which is applied through the keyboard controller interface circuit 38 to the keyboard controller 37. As a result, the keyboard controller 37 determines it from the output signal that, of the switches 223, the origin return switch has been turned on, and informs the microcomputer 1 of the depression of the origin return switch. Thereupon, the microcomputer 1 operates to move the biaxial drive unit 208 to the mechanical origin in the same manner as in the case of turning on the power switch. Similarly as in the above described case, the output signals of the switches 223 are applied to the microcomputer 1 to control the sewing machine in various manners.

Now, selection of a sewing pattern will be described.

When the group of switches 223 on the operating panel 40 are operated to specify a sewing pattern number, and then a switch for reading the sewing pattern number is turned on, the microcomputer 1 makes access to the FDC 46 through the peripheral data buffer 4 and a peripheral data line (hereinafter referred to as "a PD line," when applicable), and, in order to determine whether or not the FD 48 has been inserted in the FDD 47, outputs an instruction for moving the head of the FDD 47 and an instruction for rotating the FD 48. That is, in order to read data from the FD 48, the drive section of the FDD 47 is activated.

In order to read data from the FD 48, the CPU of the microcomputer 1 applies a data inputting instruction to the FDC 46. In response to the instruction, the FDC 46 operates to transfer data from the FD 48 to the PD line, and to store the data in the microcomputer 1 through the peripheral data buffer 4. The data thus stored is immediately transferred to the RAM 61. The above-described operations are repeatedly carried out until the end data is read. Thus, the pattern data in the FD are transferred into the RAM2.

Thereafter, the sewing pattern data in the RAM2 61-*b* are converted into data which are most suitable for the operation of the automatic sewing machine, and transferred into the RAM3 61-*c*. In this connection, it goes without saying that the following method may be employed: The data in a pattern ROM (not shown) are outputted, and the microcomputer 1 reads the sewing pattern data temporarily. In this case, the sewing pattern data are converted into data which are most suitable for the operation of the automatic sewing machine, so as to be applied to the RAM2.

The automatic sewing machine cannot be operated with appropriate sewing pattern data as described below:

1. Sewing speed

Figure 4:
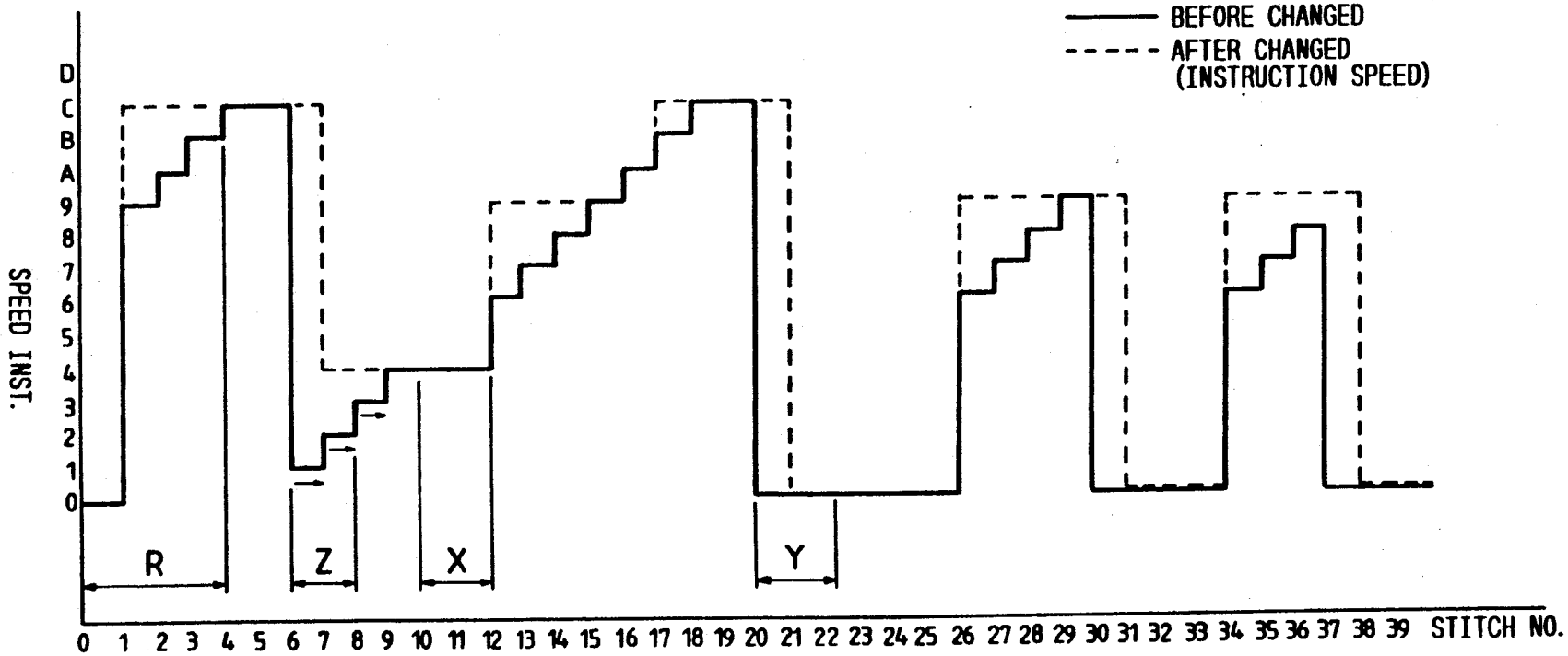
FIG. 4 is a graphical representation indicating relationships between sewing speeds to be changed and sewing speeds changed.
Figure 5:
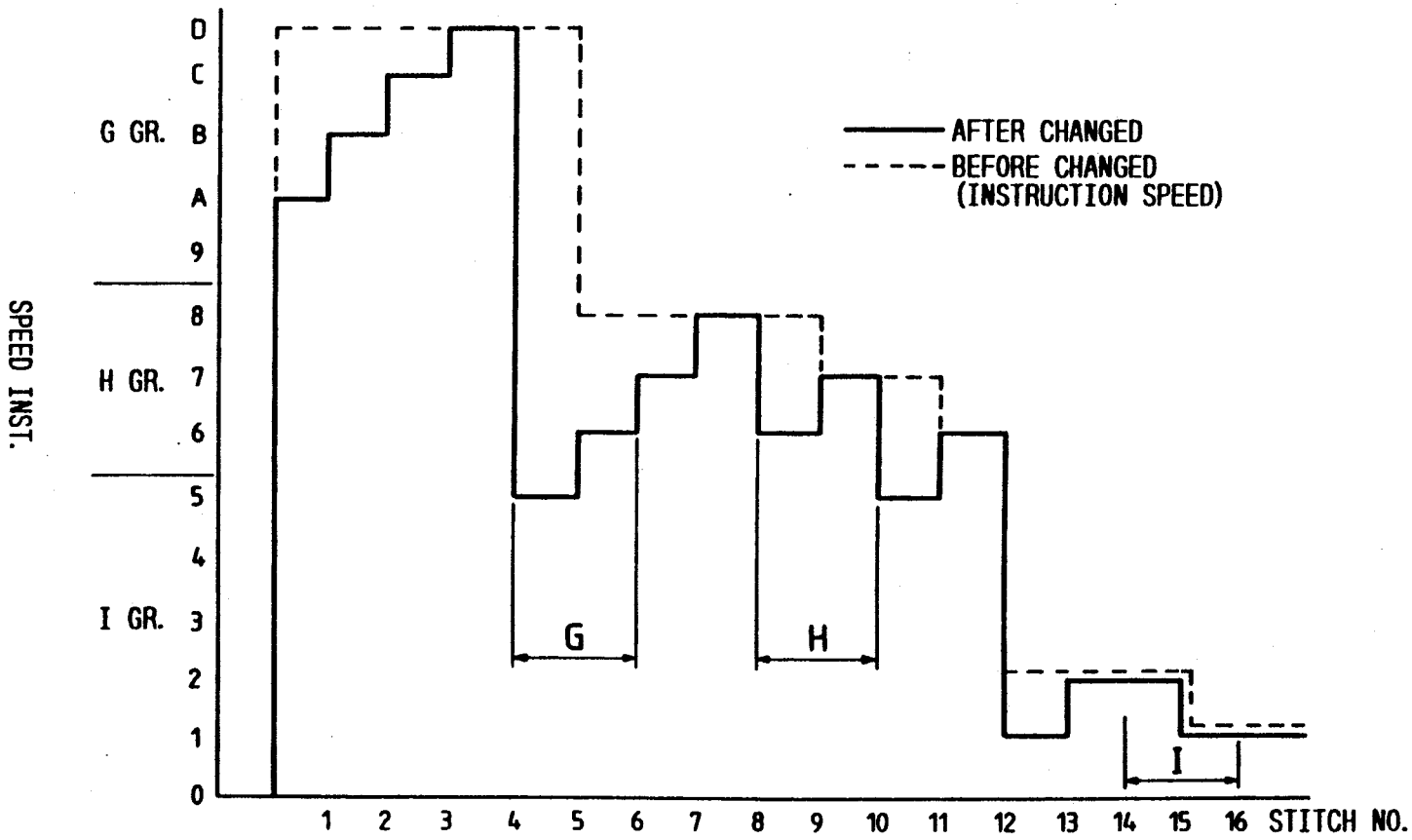
FIG. 5 is a graphical representation indicating relationships between sewing speeds to be changed and sewing speed changed under the conditions different from those in FIG. 4.

In FIG. 4, the broken line shows sewing speeds before the rotation speed has been changed, and the solid line shows sewing speeds after the rotation speed has been changed. Further in FIG. 4, the vertical axis represents sewing speeds, and the horizontal axis the numbers of stitches. FIG. 5 indicates sewing speeds before and after changed under the conditions different from those in FIG. 4.

Figure 6:
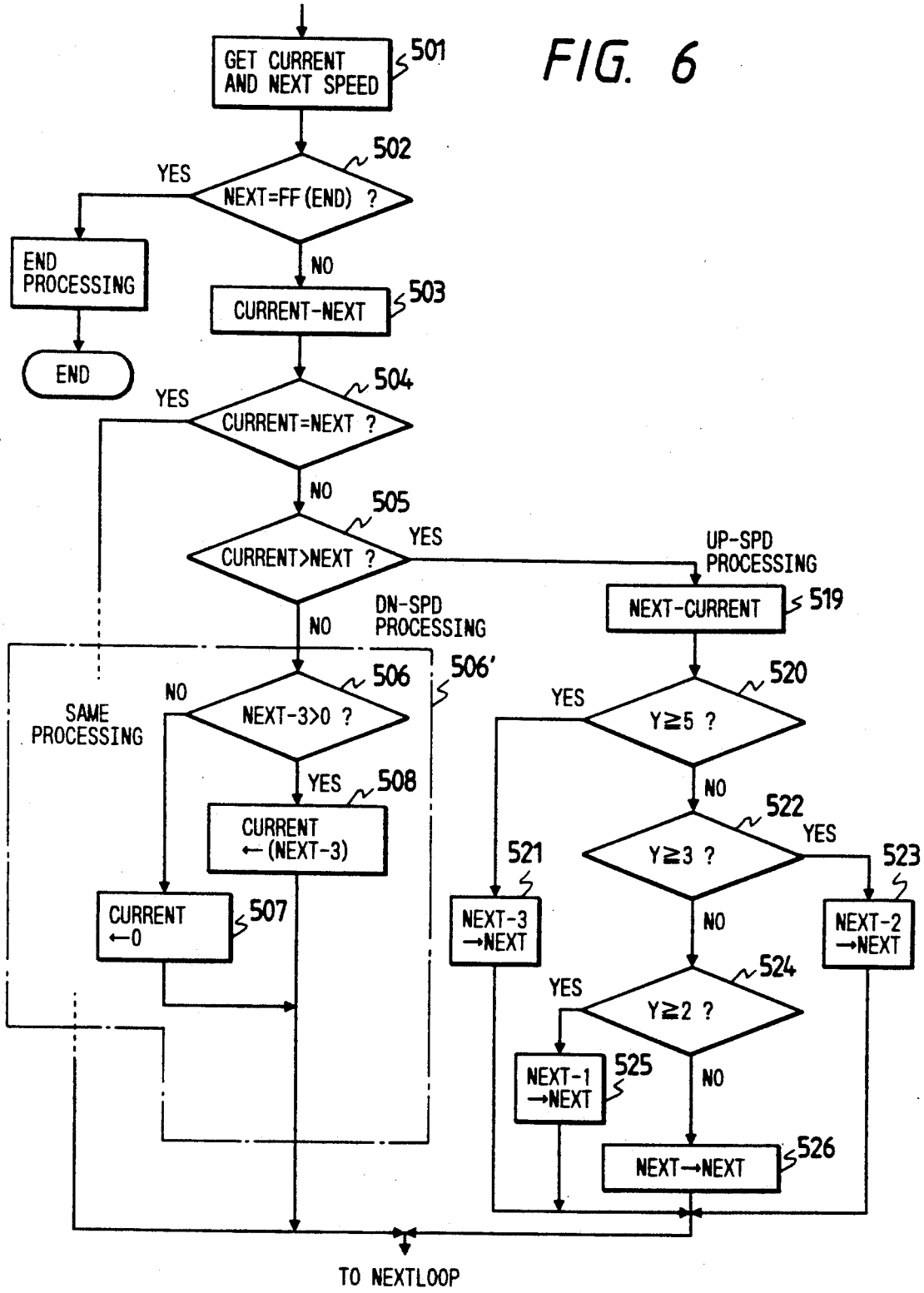
FIG. 6 is a flow charge for a description of the speed changing operations shown in FIGS. 4 and 5.

A speed changing method as shown in FIGS. 4 and 5, which is capable of decelerating the sewing speed quickly and accurately and also accelerating the sewing speed without over-shoot will be described with reference to FIG. 6, a flow chart. In Step 501, the current sewing speed and the next sewing speed are stored in the CPU of the microcomputer 1. Step 501 is a routine for determining whether or not the next sewing data has been ended. When it is determined that the next sewing data has been ended, another routine is effected to end the operation of the automatic sewing machine. When it is determined that the next sewing data has not been ended yet, Step 503 is effected; that is, the next sewing speed is subtracted from the current sewing speed. Thereafter, Step 504 is effected. That is, in Step 504, the current sewing speed and the next sewing speed is subjected to comparison by using the result of the operation in Step 503. When these two sewing speeds are equal to each other, a "same" process is performed; that is, a process is carried out in step 506' under the condition that the current sewing speed is equal to the next sewing speed. In FIG. 4, the region X corresponds to the same process carried out in Step 506'. When, on the other hand, it is determined in Step 504 that the two sewing speeds are different from each other, Step 505 is effected to subject the current sewing speed and the next sewing speed to comparison. When it is determined in Step 505 that the current sewing speed is higher than the next sewing speed; i.e., the sewing speed is decreased, Step 519 is effected. When it is determined that the next sewing speed is higher; i.e., the sewing speed is increased, Step 506 is effected. In the case where the sewing speed is decreased, the sewing speed is controlled as follows: Fundamentally, with the response characteristic of the motor taken into account, at the stitch which is immediately before the stitch at which the sewing speed should be decreased, the speed instruction value is made lower than the next sewing speed, so that, when the next stitch is actually taken, the next sewing speed is obtained. This sewing speed control will be described beginning with Step 506. In this case, the sewing speed is represented by a sewing speed level signal having levels which is obtained by dividing a maximum sewing speed into a predetermined levels equally such as 0 to 9 and A to D on the vertical axis of FIGS. 4 and 5. In Step 506, the level which is lower by three levels than the next sewing speed level is compared with zero (0). (See the region Z in FIG. 4.) For instance in the case where the current sewing speed level is 9 and the next sewing speed level is 3, $3-3=0$. When the result is smaller than zero (0), Step 507 is effected. In Step 507, zero (0) is applied as (instructed as) the current sewing speed level so that the speed instruction value may not be smaller than zero (0), and then the next loop is taken. This corresponds to the region Y in FIG. 4. In the case of the region Y, the current sewing speed level is C, and the next sewing speed level is zero (0). Therefore, in Step 506

$0-3=-3<0$, and therefore Step 507 is effected, so that zero (0) is applied as the current sewing speed level. Thus, it can be understood that, at the stitch which is immediately before the stitch where the sewing speed should be changed, the current speed instruction value is made equal to the next instruction value. When, on the other hand, in Step 506 (the level which is lower by three levels than the next sewing speed)>0, Step 508 is effected. In this case, the operation is carried out with the level [(next sewing speed level)−3] as the current sewing speed level. The region Z in FIG. 4 corresponds to the result of Step 508. In the flow chart, (next sewing speed level) −3 in Step 506; that is, the fixed level "3" is employed in Step 506. However, instead of the fixed level "3," a level may be employed which is variable with a current sewing speed level. In this case, the following method may be employed. For instance, the sewing speed levels are divided into three groups G, H and I as shown in FIG. 5, and the process is performed as shown in the following Table 1 depending on the group to which the current sewing speed level belongs: It can be considered that the levels −3, −1 and 0 in Table 1 are changed depending on the characteristic of deceleration of the motor for rotating the spindle of the sewing machine and the characteristic of rotation of the sewing machine; and it goes without saying that the levels may be positive, for instance +1 and +2, depending on the combination of a sewing machine and a motor.

TABLE 1

| Current Sewing Speed Level Group | x in [(Next sewing speed level - x] | Current Sewing speed level (Instruction speed) | Region in FIG. 5 |
|---|---|---|---|
| G | 3 | (next sewing speed level) - 3 | G |
| H | 1 | (next sewing speed level) - 1 | H |
| I | 0 | (next sewing speed level) - 0 | I |

Figure 7:
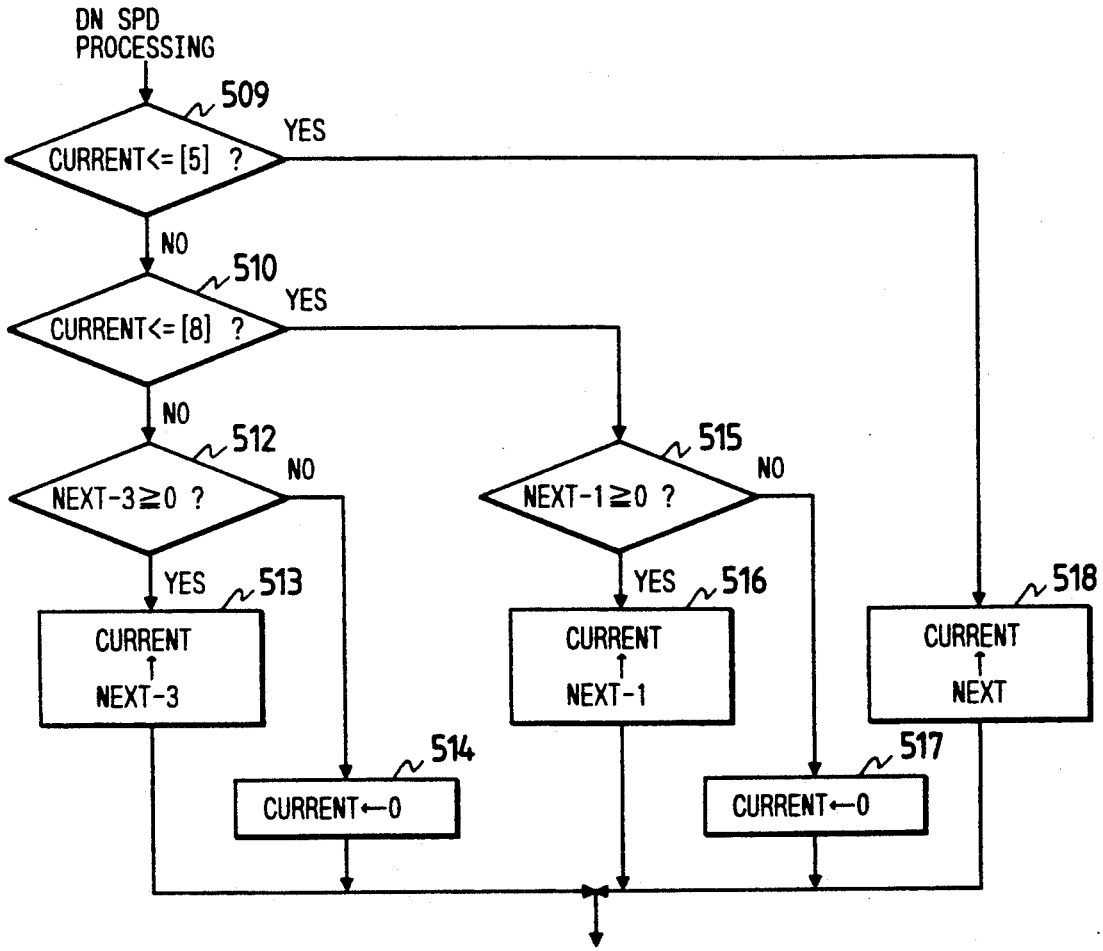
FIG. 7 is a flow charge for a description of a process to be performed when the speed is decreased.

This control will be described with reference to FIG. 7, a flow chart. Instead of the process for deceleration encircled by the one-dot chain line in FIG. 6, a process for deceleration in FIG. 7 is employed. In Step 509, it is determined whether or not the current sewing speed level is equal to or lower than five (5), When it is determined that the current sewing speed level is equal to or lower than five (5), Step 518 is effected. In Step 518, the next sewing speed level is employed as the current sewing speed level, and the present process is ended to taken another loop. When the current sewing speed level is equal to or higher than six (6), Step 510 is effected. In Step 510, it is determined whether or not the current sewing speed level is equal to or lower than eight (8). When it is determined that the current sewing speed level is equal to or lower than eight (8), Step 515 is effected. In Step 515, it is determined whether or not the level obtained by subtracting one (1) from the next sewing speed level is smaller than zero (0). In the case where the next sewing speed level is zero (0), the result of subtraction is −1, and therefore Step 517 is effected. In Step 517, zero (0) is applied as the current sewing speed level, and the present process is ended to take another loop. When in Step 515 the result of {(next sewing speed level) −1} is equal to or larger than zero (0), Step 516 is effected. The level {(next sewing speed level) −1} is applied to the current sewing speed, and the present process is ended to take another loop. When, on the other hand, it is determined in Step 510 that the current sewing speed level is larger than eight (8), Step 512 is effected. In Step 512, the level obtained by subtracting three (3) from the next sewing speed level is smaller than zero (0). When the result of subtraction is smaller than zero (0), Step 514 is effected. In Step 514, zero (0) is applied as the current sewing speed level, and the present process is ended to take another loop. When, on the other hand, it is determined in Step 512 that the result of subtraction {(next sewing speed level) −3} is equal to or larger than zero (0), Step 513 is effected. In step 513, the level obtained by subtracting three (3) from the next sewing speed level is applied as the current sewing speed level, and the present process is ended to taken another loop. Thus, the processes as shown in the regions G, H and I in FIG. 5 have been achieved.

Now, the process will be described which is performed when the sewing speed is increased (acceleration). When, in Step 505 (FIG. 6) the next sewing speed level is higher than the current sewing speed level, Step 519 is effected. In Step 519, an arithmetic operation is carried out for the comparisons in Steps 520, 522 and 524; that is, the level Y is calculated which is obtained by subtracting the current sewing speed level from the next sewing speed level. Next, Step 520 is effected. When, in Step 520, the level Y is equal to or larger than five (5), Step 521 is effected, in which the level obtained by subtracting three (3) from the next sewing speed level is instructed as the current sewing speed level. Then, the present process is ended to take another loop. When, on the other hand, the level Y is smaller than five (5), Step 522 is effected. In the Step 522, it is determined whether or not the level Y is equal to or larger than three (3). When it is determined that the level Y is equal to or larger than three (3), Step 523 is effected in which the level obtained by subtracting two (2) from the next sewing speed level is instructed as the current sewing speed level, and then the present process is ended. When it is determined in Step 522 that the value Y is smaller than three (3), Step 524 is effected. In Step 524, it is determined whether or not the level Y is equal to or larger than two (2). When the level Y is equal to or larger than two (2), Step 525 is effected in which the level obtained by subtracting one (1) from the next sewing speed level is instructed as the current sewing speed level, and then the present procedure is ended. When, on the other hand, it is determined that the level Y is smaller than two (2), Step 526 is effected in which the next sewing speed level is instructed without subtraction, and the present process is ended. The above-described operations are carried out for every stitch, so that, when the sewing speed is increased, the speed instruction level is stepwise as shown in the region R in FIG. 4.

As was described with reference to the prior art, those which limit the sewing speed are a speed instruction as to stitch length and stitch data, and the speed setting switch on the operating panel. As for the sped instruction as to stitch length and stitch data, the speed instruction value is determined by the above-described method. On the other hand, the speed set with the speed setting switch on the operating panel takes precedence over the speed instruction as to stitch length and stitch data. For instance in the case where the sewing speed by stitch length is C, and the speed instruction as to stitch data is high, while the speed set by the speed setting switch is "5," then the speed instruction level will be "5." FIG. 4 will be described with respect to the case where the speed set by the speed setting switch is "4." In the case where the speed setting switch is set to "4," the speed instruction values for the sixth, seventh and eight stitches are lower than the sewing operation permitting speed. In order to provide a constant sewing speed in this case, the current sewing speed is compared with the speed set by the speed setting switch, and the smaller is employed as the current sewing speed. Under this condition, the procedures shown in FIGS. 6 and 7 are performed. Hence, "4" is provided for the sixth, seventh and eighth stitches.

2. Cloth Presser Means

FIG. 2 shows a circuit for determining the timing of operation of the cloth presser. The control center, namely, the microcomputer 1, reads sewing pattern data from the RAM3 61-*c*, and utilizes the sewing speed and stitch length included in the sewing pattern data. That is, the microcomputer 1 operates to determined a count borrow value by using a table in the ROM which indicates sewing speed with stitch length (hereinafter referred to as "a count borrow table," when applicable), and apply the count borrow value thus determined through the data buffer 4 and the I/P 8 to a counter 100. That is, the count borrow value is written in the counter 100. Under this condition, the counter 100 counts the PG signal which the detector 26 on the side of the sewing machine body applies through the connector 18 and an input circuit 10 to the counter 100. The counter 100 outputs a borrow signal BR when it has counted the PG signal to the count borrow value. The borrow signal BR is applied through an OR circuit to a latch circuit 102, wherein it is latched. The OR circuit is to prevent the provision of the borrow signal when the counter has been set, that is when a set input signal is applied to the counter. The count borrow 2 signal thus latched is applied to an interruption controller, thus interrupting the operation of the microcomputer 1. Because of this interruption, the microcomputer 1 starts applying an output through the I/O 8 to the PMD 9, and the PMD 9 starts driving the PM. The rotation of the PM thus started is converted into parallel motion, so that the cloth presser is moved in a predetermined direction. That is, by using software (S/W) for reading the count borrow table, the timing of operation of the cloth presser can be freely changed. This will be concretely described with reference to FIGS. 8 and 9.

Figure 8:
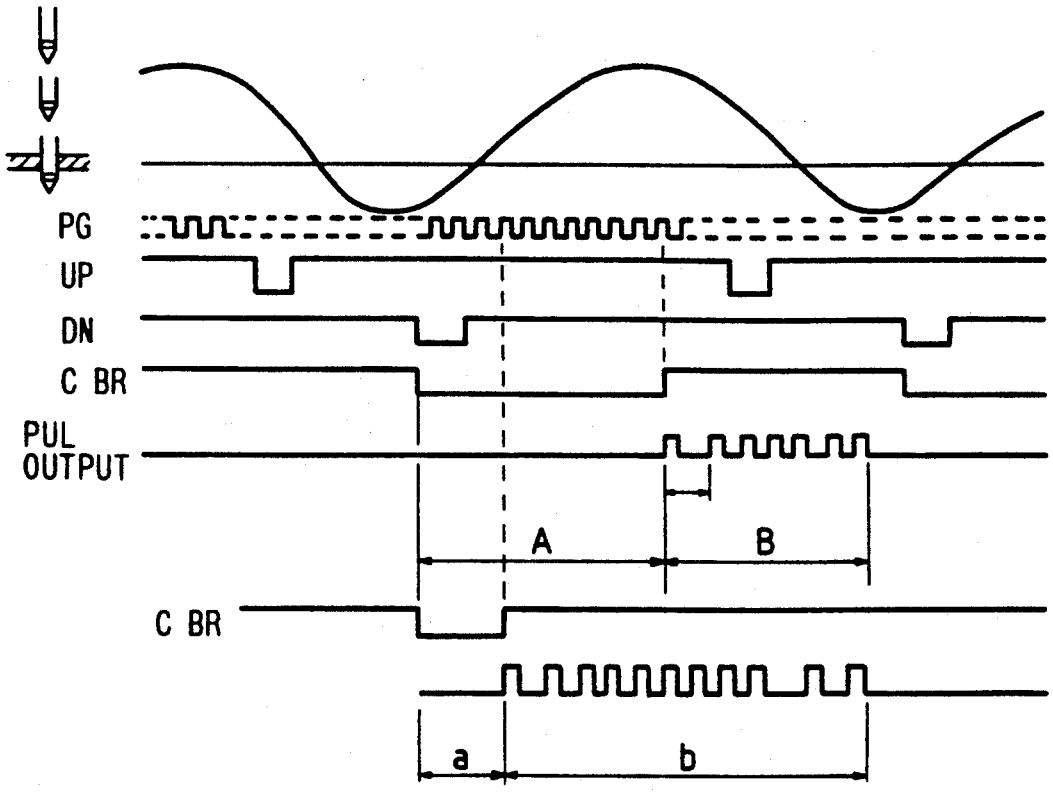
FIG. 8 is an explanatory diagram indicating relationships between the timing of movement of a needle bar and waveforms such as for instance the waveform of a PG signal during a low speed operation.

FIG. 8 is for the case where the spindle of the automatic sewing machine rotates at low speed. The curve in the uppermost part of FIG. 8 indicates the timing of operation of the needle bar. While the curve is below the horizontal line, the need is stuck into the cloth. The second, third and fourth signals from top are the PG signal, the upper position signal and the lower position signal, respectively, which are provided by the detector 26 on the side of the sewing machine body. The fifth signal is the count borrow 2 signal. The count borrow 2 signal is produced when eleven (11) PG signals are inputted; that is, eleven pulses are set in the counter. In the embodiment, the counter is set with the fall of the lower position signal. The sixth signal from top is the pulse signal which is applied through the I/O 8 to the PMD 9.

Figure 9:
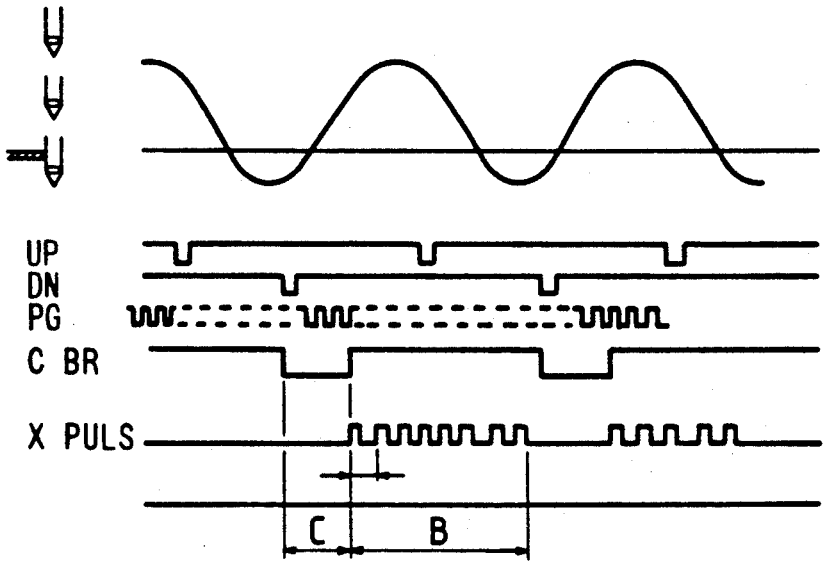
FIG. 9 is an explanatory diagram indicating relationships between the timing of movement of a needle bar and waveforms such as for instance the waveform of the PG signal during a high speed operation.
Figure 10:
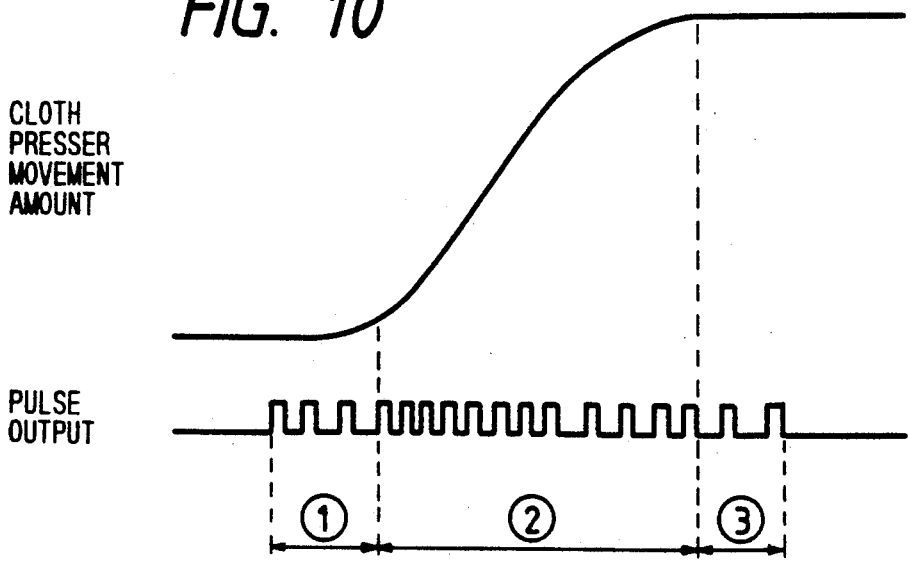
FIG. 10 is an explanatory diagram indicating amounts of movement of a cloth presser with pulse outputs through an I/0.

The seventh and eight waveforms from top are for the case where the number of pulses is different from that in the above-described case; that is, for the case where the amount of movement of the cloth presser is large. More specifically, the seventh waveform is the waveform of the count borrow 2 signal. The seventh waveform rises upon arrival of four PG signals. With this timing, the pulse signal is applied through the I/O 8 to the PMDs 27 and 28, so that the PMDs 27 and 28 are rotated to move the cloth presser. As is apparent from the comparison of B and b, and A and a in FIG. 8, as the number of pulses are outputted is increased (b>B), and in the case where the number of pulses is large, the period of time is short which elapses from the time instant that the lower position signal falls until the pulse is outputted (a>A). That is, in the case where, even if the automatic sewing machine is constant in the speed of rotation, the stitch length is long, it is necessary to output the pulse earlier in order to move the cloth presser. On the other hand, FIG. 9 shows pulse output waveforms provided during the high speed rotation in which the number of pulses is seven (7) similarly as in the upper part of FIG. 8. Even when the automatic sewing machine rotates at high speed, no change occurs for the period of time the pulses are produced as indicated at B. Hence, the region A in FIG. 8 comes out short as indicated at C in FIG. 9, corresponding to four PG signals. FIG. 10 indicates the relation between the amount of movement of the cloth presser and the pulse output from the I/O 8. In FIG. 10, for the period of time (1), the cloth presser is not moved yet although the pulses are outputted; for the period of time (2), the cloth presser is moved; and the period of time (3), the cloth presser is held stopped although the pulses are outputted. As was described above, for the period of time (1), the cloth presser is not moved although the pulses are outputted. Hence, the generation of the cloth presser driving pulses through one revolution may be started while the needle is stuck into the cloth, and therefore the value C in FIG. 9 may be zero (0).

Figure 15:
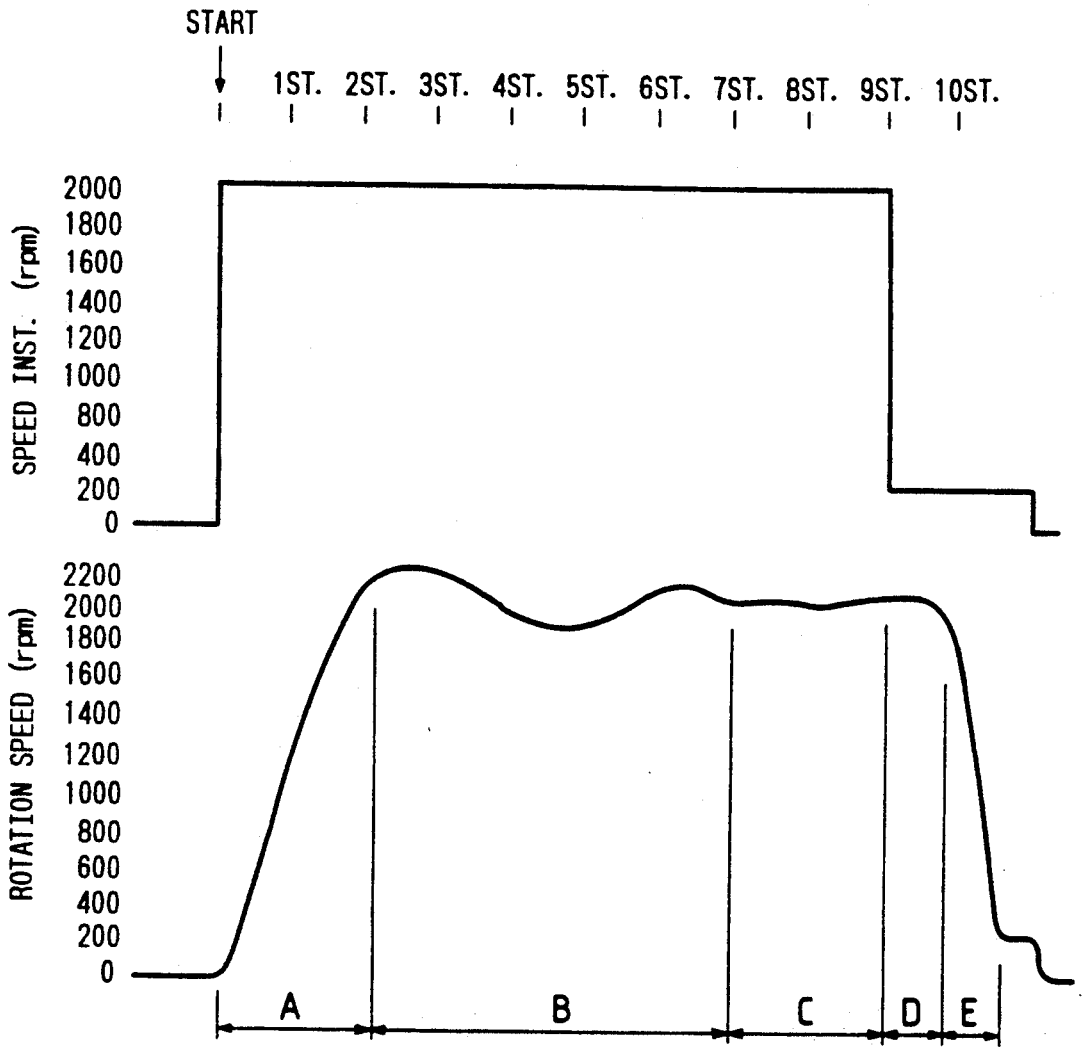
FIG. 15 is an explanatory diagram for a description of the arrangement of a control device in the automatic sewing machine shown in FIG. 14.
Figure 16:
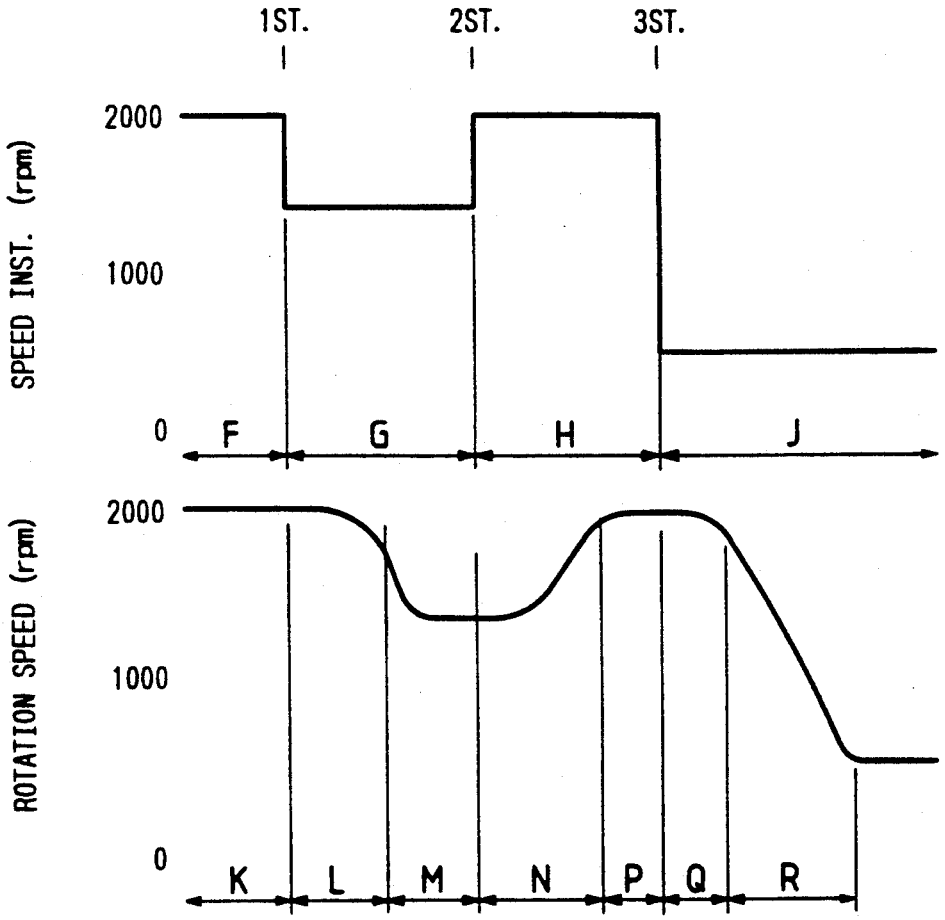
FIG. 16 is an explanatory diagram for a description of the speed reducing operation of the conventional automatic sewing machine.
Figure 17:
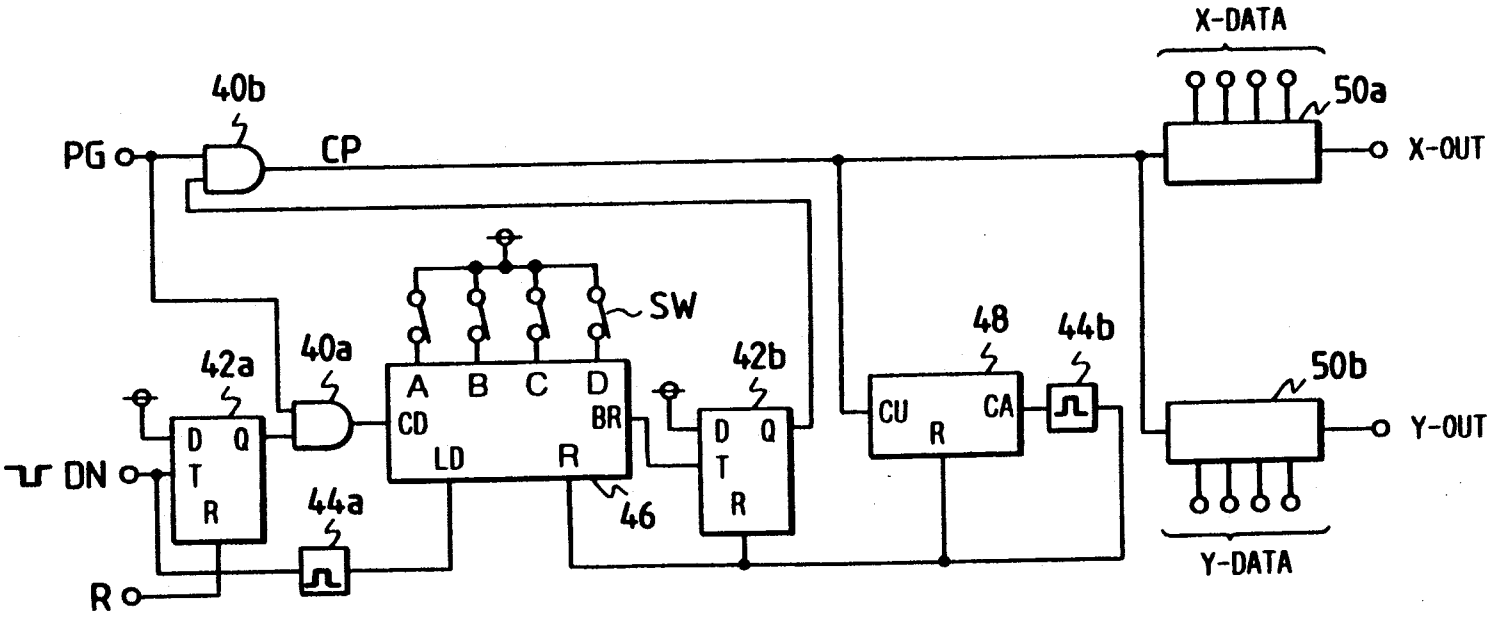
FIG. 17 is an explanatory diagram showing a feed pulse delay circuit in the conventional automatic sewing machine.
Figure 18:
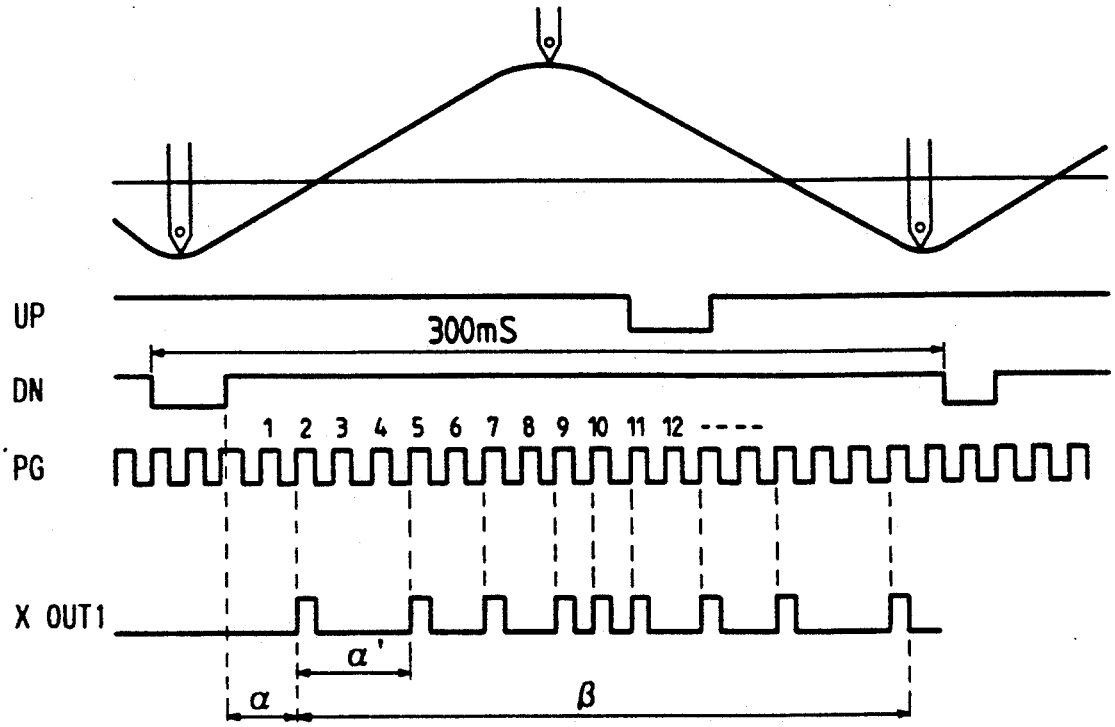
FIG. 18 is an explanatory diagrams showing the waveforms of various signals in the conventional automatic sewing machine during low speed operation.
Figure 19:
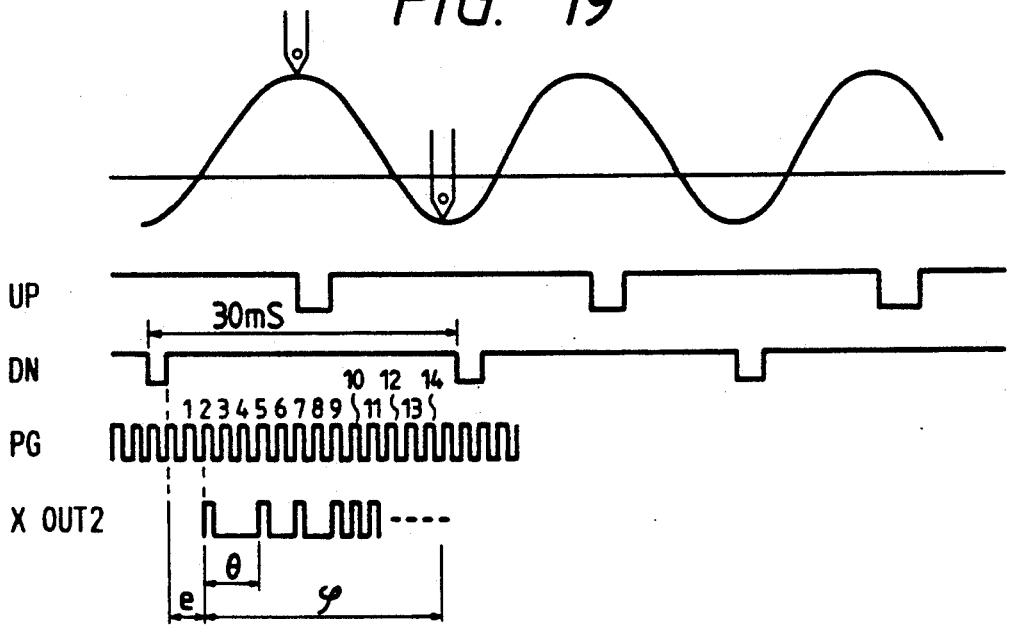
FIG. 19 is an explanatory diagrams showing the waveforms of various signals in the conventional automatic sewing machine during high speed operation.
Figure 20:
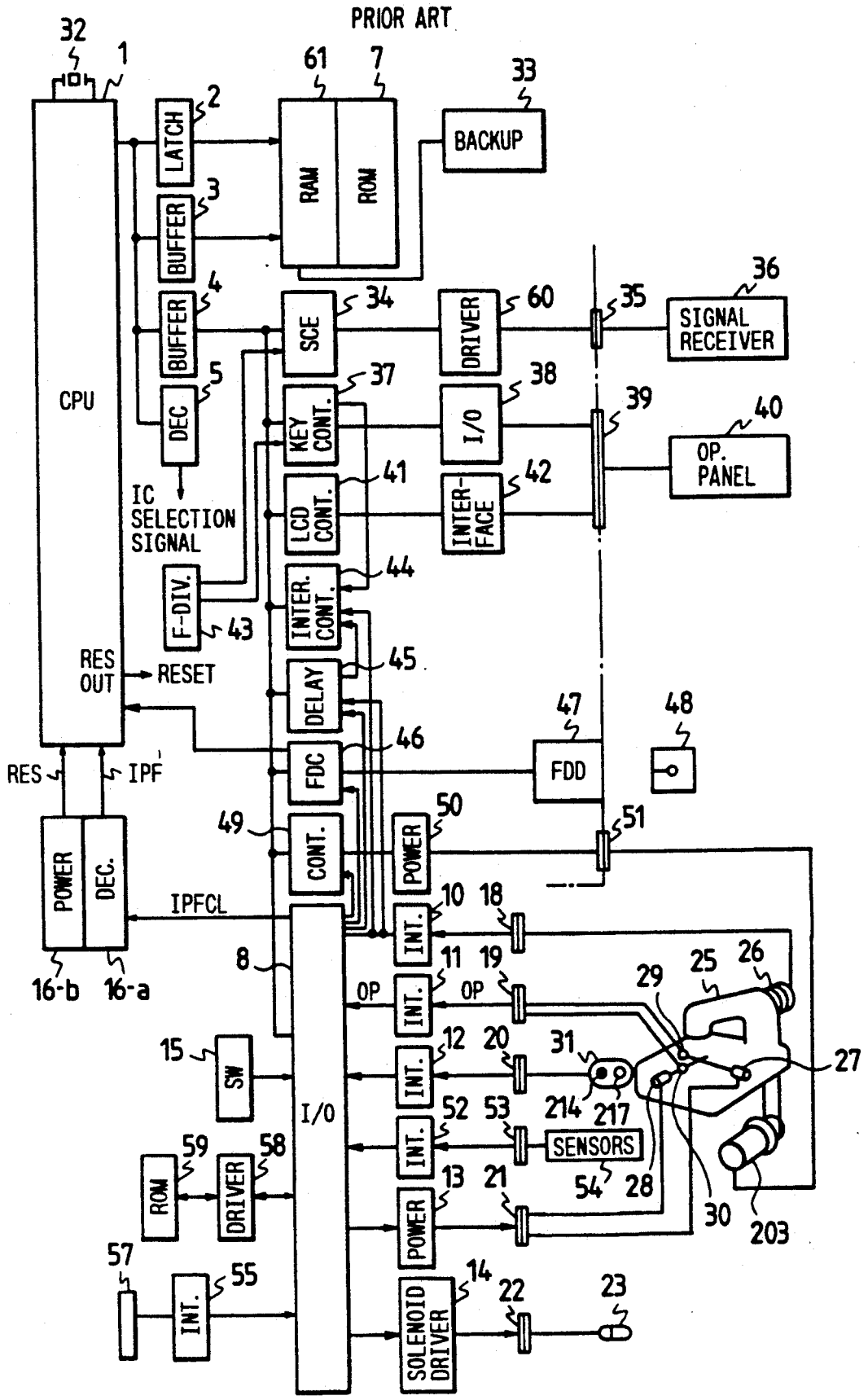
FIG. 20 PRIOR ART
FIG. 20 is a block diagram showing the control device in the conventional automatic sewing machine.

The timing of generation of the count borrow 2 signal has been described which is determined from the speed instruction value and the stitch length; however, it should be noted that, in practice, the speed of rotation of the spindle of the sewing machine cannot respond immediately to an acceleration or deceleration instruction. This time delay can be clearly understood from FIG. 15. For instance, at the rise, the speed instruction value is 2000 rpm, while the speed of rotation of the sewing machine spindle is of the order of 1000 rpm; and at the time of deceleration, although a speed instruction value of 100 rpm is given, a speed of 2000 rpm is maintained for one revolution. Hence, if, in this case, the timing of generation of the count borrow 2 signal is determined only from the relation between the speed instruction value and the stitch length, then the feeding of the cloth presser will not match with the speed of rotation, and accordingly it is impossible to form a fine seam. Therefore, at the time of acceleration or deceleration, a value different from the speed instruction value is obtained from the count borrow table, so as to match the timing of the count borrow 2 signal with the practical speed.

Figure 11:
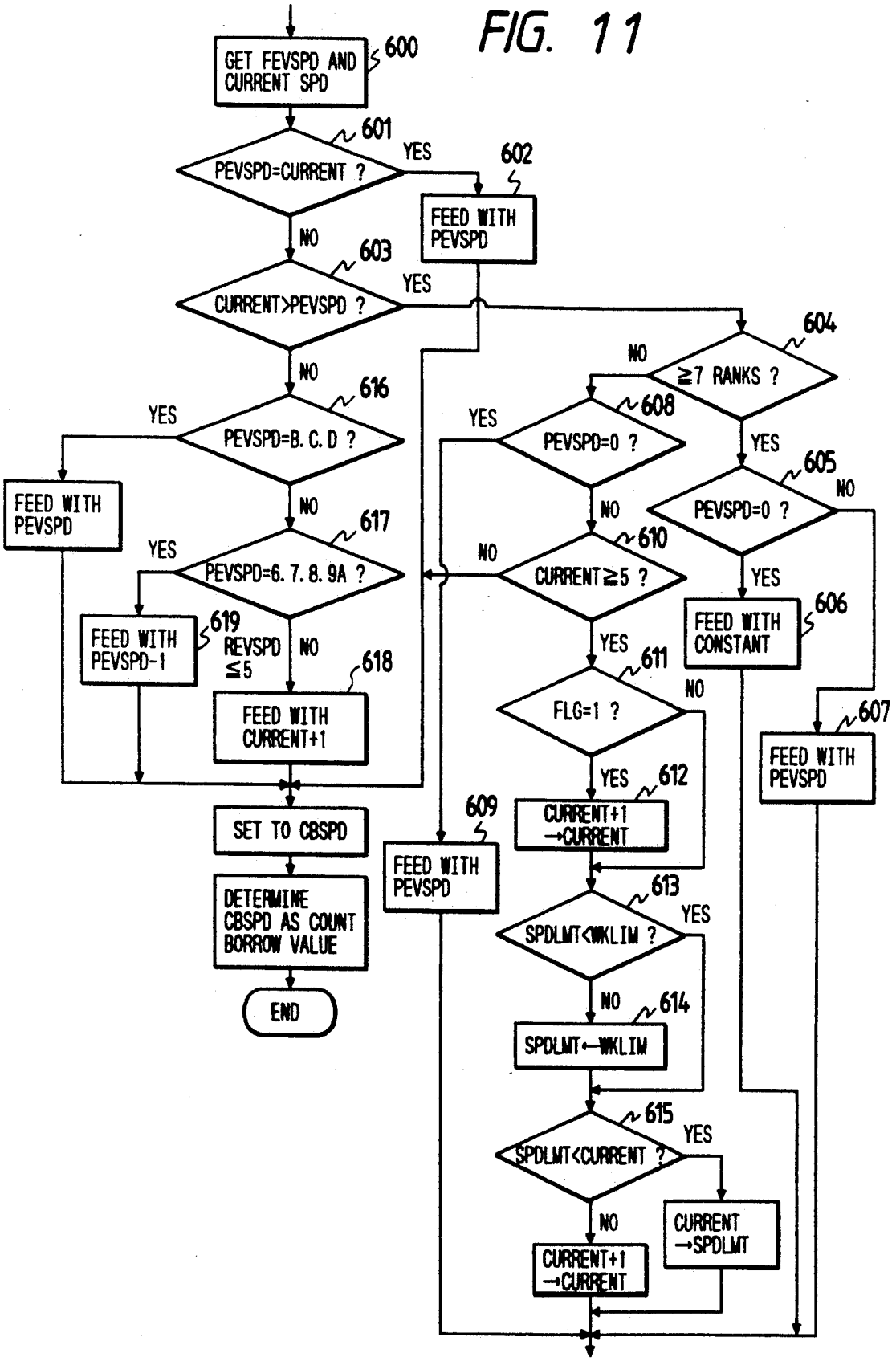
FIG. 11 is a flow Chart for a description of the operation of the control device according to the invention.
Figures 12, 13:
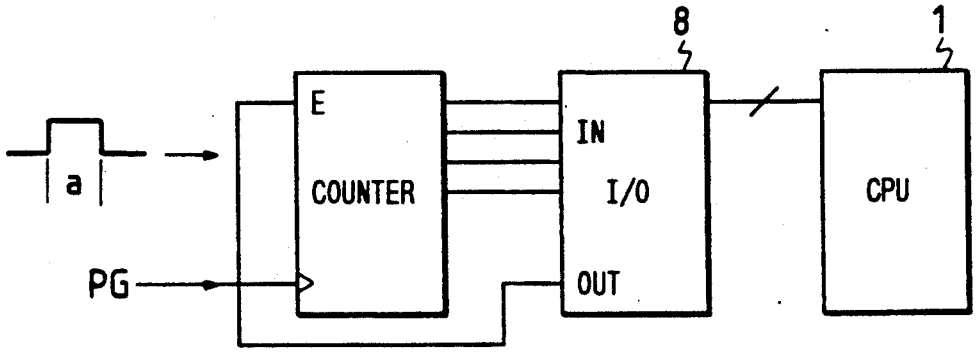
FIG. 12 is an explanatory diagram indicating stitch lengths with speeds.
FIG. 13 is a block diagram showing one example of a circuit for measuring the speed of rotation of the sewing machine.

The operations described above in brief or in detail will be further described with reference to FIGS. 11 and 12. FIG. 11 is a flow chart, and FIG. 12 is a count borrow table indicating speed with stitch length for determination of the timing of generation of the count borrow 2 signal. The count borrow table is stored, as a program, in the ROM 7. A method of determining the timing of generation of the count borrow 2 signal will be described with reference to the flow chart of FIG. 11. It is assumed that the stitch length has been determined being calculated by the respective routine (not shown). In addition, it is assumed that the speed PEVSPD at the stitch which is immediately before the current stitch (hereinafter referred to as "a PEVSPD," when applicable), the current speed CURRENT, the speed limit 1 SPDLMT (which is a stitch length, and is hereinafter referred to as "an SPDLMT," when applicable), and a speed limit 2 WKLIM (which is a dial value, and is hereinafter referred to as "a WKLIM," when applicable) have been determined by the respective routines or set manually.

In Step 600, the microcomputer provides the PEVSPD and the CURRENT. In Step 601, it is determined whether or not the PEVSPD is equal to the CURRENT. When it is determined that the PEVSPD is equal to the CURRENT, Step 602 is effected. In Step 602, in order to feed the cloth presser at the PEVSPD, a stitch length and a speed are selected by referring to the table shown in FIG. 12. When, on the other hand, the PEVSPD is not equal to the CURRENT, Step 603 is effected. In Step 603, the PEVSPD and the CURRENT are subjected to comparison. When the CURRENT is higher than the PEVSPD; that is, when the speed is increased, Step 604 is effected. In Step 604, it is determined whether or not the speeds differ by seven ranks or more. The "seven ranks" is the threshold value from which it is determined whether or not the speed is quickly increased. When it is determined in Step 604 that the speeds differ by seven ranks or more, Step 605 is effected. In the Step 605, it is determined whether or not the PEVSPD is zero (0). When the PEVSPD is zero (0), Step 606 is effected. In Step 606, a predetermined value is applied to the count borrow speed (hereinafter referred to as "a CBSPD," when applicable), and reference is made to the count borrow table, so that the count borrow value is determined by using the count borrow speed and the stitch length. Thus, the present routine is ended. When, in Step 605, the PEVSPD is not zero (0), Step 607 is effected. In Step 607, the cloth presser is moved at the PEVSPD; that is, the PEVSPD is substituted for the BSSPD, with which the count borrow value is determined. Thus, the present routine is ended. In the case where, in Step 604, the speeds differ by six ranks or less, Step 608 is effected. In Step 608, it is determined whether or not the PEVSPD is zero (0). When PEVSPD =0, Step 609 is effected. In Step 609, the cloth presser is moved at the PEVSPD; that is, the PEVSPD is substituted for the BSSPD, with which the count borrow value is determined. Thus, this routine is ended. Went the PEVSPD is not zero, Step 610 is effected. In Step 610, it is determined whether or not the CURRENT is equal to or higher than five (5). When it is determined is Step 610 that the CURRENT is four (4) or less, Step 608 is effected with respect to the PEVSPD again. When it is determined in Step 610 that the CURRENT is equal to or lower than four (4) (sic), Step 611 is effected. In Step 611, determination is made by referring to a flag FLG. The flag FLG becomes zero (0) when, in the case where a process for acceleration is performed repeatedly with [(current speed)=1], the current speed is equal to the next speed. Thus, in the case where it is detected during the process for acceleration that the current speed is equal to the next speed, Step 613 is effected. In the case where, on the other hand, the current speed is not equal to the next speed, Step 612 is effected. In step 612, the value (CURRENT+1) is substituted for the CURRENT, and then step 613 is effected. In Step 613, the SPDLMT and the WKLIM are subjected to comparison. When the WKLIM is larger, Step 615 is effected. When the SPDLMT is larger, the WKLIM is substituted for the SPDLMT (Step 614), and then Step 615 is effected. In this routine, priority is given to the WKLIM. In Step 615, the CURRENT is compared with the SPDLMT. When the SPDLMT is smaller than the CURRENT, the SPDLMT is substituted for the CURRENT, and the resultant CURRENT is substituted for the CBSPD, with which the count borrow value is determined. Thus, the routine is ended. In the case where, in Step 615, the SPDLMT is larger than the CURRENT, (CURRENT +1) is substituted for the CURRENT, and the resultant CURRENT is substituted for the CBSPD, with which the count borrow value is determined. Thus, the routine is ended.

Now, the case will be described where it is determined in Step 603 that the PEVSPD is higher than the CURRENT. In this case, Step 616 is effected. In Step 616, it is determined whether or not the PEVSPD is ranked at least at B. When the rank is equal to or higher than B, the cloth presser is moved at the PEVSPD. Therefore, the PEVSPD is substituted for the CBSPD, with which the count borrow value is determined. Thus, the routine is ended. When it is determined in Step 616 that the rank of the PEVSPD is lower than any one of the ranks B, C and D, Step 617 is effected. In Step 617, determination is made for the rank of the PEVSPD; that is, it is determined which of the ranks 6, 7, 8 and A (sic) the PEVSPD has. When it is determined that the PEVSPD has the rank 6, 7, 8 or A, the cloth presser is moved at (CURRENT+1). The (CURRENT+1) is substituted for the CBSPD, with which the count borrow value is determined. Thus, the routine is ended.

Now, a method of determining the timing of generation of the count borrow 2 signal by measuring the speed of rotation of the automatic sewing machine will be described with reference to FIG. 13. FIG. 13 shows one example of a circuit for measuring the speed of rotation of a sewing machine. The circuit is designed as follows: The microcomputer applies a pulse signal have a predetermined pulse width (a) through an I/0 to a counter to enable the latter to count. On the other hand, the PG signal outputted by the detector is applied to the counter to enable the counter to count. That is, the counter provides an output depending on the number of PG signals applied during the period of time corresponding to the pulse width (a), and the output of the counter is applied through the I/0 8 to the microcomputer, to allow the latter to calculate the speed of rotation of the sewing machine. With the circuit, the speed of rotation of the automatic sewing machine is detected, and the speed for the next stitch is estimated from the speed instruction value and the speed thus detected, as a result of which a most suitable count borrow signal 2 can be obtained. That is, the timing of generation of the count borrow 2 signal is determined by using the speed which is closest to the actual speed. More specifically, the control operation is carried out according to the flow chart of FIG. 11 by employing, instead of the speed instruction value for the stitch which is immediately before a given stitch, the actually measured speed for it. Thus, the timing of movement of the cloth presser is more practical.

It goes without saying that it is not always necessary for the means for changing sewing pattern data into ones most suitable for the operation of the sewing machine to accomplish all the operations before the start of the sewing machine. For instance, optimization of the sewing speed can be made during sewing.

In the above-described embodiment, the sewing speed is optimized being digitally limited to the ranks 1 through C. However, it goes without saying that the number of ranks may be increased so that the speed may be considered as analog signals ultimately.

As for the timing of movement of the cloth presser, in the embodiment the PG signal is counted to provide the count borrow 2 signal. However, it goes without saying that a signal synchronous with the sewing machine spindle may be employed instead of the PG signal. Furthermore, in the above-described embodiment, the pulse signal is employed for movement of the cloth presser; however, it goes without saying that the signal can be employed with which, as in a servo system, the movement time is somewhat limited by specifying the amount of movement and the moving speed. Furthermore, in the above-described embodiment, hardware (H/W)is employed for production of the count borrow 2 signal; however, it goes without saying that the following method may be employed: An interruption signal or the like is used to cause the microcomputer 1 to detect the PG signal, and software (S/W) is used to count the PG signal, thereby to start outputting the pulse signal. In addition, for detection of the speed, the following method may be employed: An interruption signal or the like is used to cause the micro-computer to detect the PG signal, and the microcomputer 1 calculates the speed by using the PG signal thus detected.

As was described above, with the automatic sewing machine control device according to the present invention, the sewing speed is stabilized because of the optimization of the sewing pattern data.

What is claimed is:

1. A sewing speed control device for use in a sewing machine, comprising:

an operating speed detecting means for detecting an operating speed of said sewing machine to produce a current sewing speed level signal;

a comparison means for comparing the current sewing speed level signal detected by said operating speed detecting means with the next operating speed level to which the current operating speed is changed in response to a speed level instruction signal;

an instruction means for producing a speed level control signal corresponding to an operation speed level according to the comparison result of said comparison means; and a control means for controlling the operating speed of said sewing machine in response to the speed level control signal, the speed level control signal being determined as either a zero speed level or a positive speed level not higher than a level represented by the speed level instruction signal.

2. The sewing speed control device as defined in claim 1 wherein said instruction means determines the level of the speed level control signal according to the level of the current rotation level speed.

3. The sewing speed control device as defined in claim 2 wherein, in case of decelerating the sewing speed, said instruction means determines the level of the speed level control signal at a positive level which is obtained by subtracting a few levels from the level of the speed level instruction signal, and wherein said instruction means determines the level of the speed level control signal at zero level when a level which is obtained by said subtraction is either zero or a negative level.

4. The sewing speed control device as defined in claim 2 wherein, in case of accelerating the sewing speed, said instruction means determines the level of the speed level control signal at a level which is obtained by subtracting a few of levels from the level of the speed level instruction signal initially and said instruction means gradually increases the level of the speed level control signal.

5. The sewing speed control device as defined in claim 3 wherein the few of levels is three.

6. The sewing speed control device as defined in claim 4 wherein the few of levels is three.

7. A sewing speed control method for controlling the sewing speed of a sewing machine, comprising the steps of:

detecting the operating speed of said sewing machine to produce a current sewing speed level signal;

comparing the current sewing speed level signal with the next rotation speed level to which the current rotation speed is changed in response to a speed level instruction signal;

producing a speed level control signal corresponding to a specific operating speed level according to the comparison result; and controlling the rotation speed of said sewing machine in response to the speed level control signal, the speed level control signal being determined as either a zero speed level or a positive speed level not higher than a level represented by the speed level instruction signal.

8. A control device for controlling a sewing machine to carry out an automatic sewing operation according to a sewing pattern, data which comprise a sewing machine body, an electric motor for driving a spindle of said sewing machine body, means for detecting a speed of the rotation of the spindle of said sewing machine, a cloth presser unit for holding a cloth, a cloth presser drive section for moving said cloth presser unit to a predetermined position, and a control unit for controlling the operations of said motor, cloth presser unit and cloth presser drive section, said control unit comprising:

a microcomputer carrying out the control operations;

memory means for storing operation programs for said microcomputer and the sewing pattern data; and sewing pattern data changing means for changing the sewing pattern data into another sewing pattern data;

wherein said control unit comprises a PMD for operating said cloth presser unit drive means, count borrow means for transmitting a determination as to whether or not said PMD provide an output, count borrow writing means for writing predetermined data in said count borrow means, needle position detecting means for detecting the needle lower position of said sewing machine and drive timing changing means including PG signal generating means for outputting a PG signal at predetermined time intervals when said sewing machine is rotated, said changing means changing the drive timing of said cloth presser drive section according to a sewing machine speed instruction value.

9. The control device as defined in claim 8 wherein upon intermittent action of said cloth presser drive means, said PMD is permitted to provide an output with the aid of said count borrow means even when the needle is stuck into said cloth.

10. The control device as defined in claim 9 wherein said count borrow writing means writes predetermined data in said count borrow means, to determined the timing of generation of a start signal for said PMD, said needle position detection means detects the upper and low position of the needle, and said cloth presser timing determining means determines the timing of drive of said cloth presser unit with the aid of a speed different from a sewing machine speed instruction value.

11. The control device as defined in claim 8 wherein said changing means determines the timing of drive of said cloth presser drive section according to the speed of rotation of the spindle of said sewing machine and a speed instruction value thereof.

* * * * *